US009074145B2

(12) United States Patent
Hoehn et al.

(10) Patent No.: US 9,074,145 B2
(45) Date of Patent: Jul. 7, 2015

(54) DUAL STRIPPER COLUMN APPARATUS AND METHODS OF OPERATION

(75) Inventors: Richard K. Hoehn, Mt. Prospect, IL (US); Vedula K. Murty, Willowbrook, IL (US)

(73) Assignee: UOP LLC, De Plaines, IL (US)

( * ) Notice: Subject to any disclaimer, the term of this patent is extended or adjusted under 35 U.S.C. 154(b) by 492 days.

(21) Appl. No.: 13/558,966

(22) Filed: Jul. 26, 2012

(65) Prior Publication Data

US 2014/0027347 A1 Jan. 30, 2014

(51) Int. Cl.

| | |
|---|---|
| ***C10G 7/00*** | (2006.01) |
| ***B01D 3/00*** | (2006.01) |
| ***B01D 3/06*** | (2006.01) |
| ***B01D 3/16*** | (2006.01) |
| ***B01D 3/38*** | (2006.01) |
| ***C10G 67/04*** | (2006.01) |
| ***C10G 45/00*** | (2006.01) |
| ***C10G 47/00*** | (2006.01) |

(52) U.S. Cl.
CPC ..... *C10G 67/04* (2013.01); *C10G 45/00* (2013.01); *C10G 47/00* (2013.03)

(58) Field of Classification Search
CPC ..... C10G 7/00; C10G 45/00; C10G 47/00; C10G 67/04; C10G 9/00; B01D 3/00; B01D 3/06; B01D 3/065; B01D 3/14; B01D 3/143; B01D 3/16; B01D 3/163; B01D 3/18
See application file for complete search history.

(56) References Cited

U.S. PATENT DOCUMENTS

| | | | |
|---|---|---|---|
| 3,719,027 | A | 3/1973 | Salka |
| 6,787,025 | B2 | 9/2004 | Mukherjee et al. |
| 8,715,596 | B2 * | 5/2014 | Hoehn et al. ..... 422/609 |
| 2008/0184887 | A1 | 8/2008 | Mak |

* cited by examiner

*Primary Examiner* — Walter D Griffin
*Assistant Examiner* — Derek Mueller
(74) *Attorney, Agent, or Firm* — James C. Paschall

(57) ABSTRACT

Dual stripper column arrangements are described in which hot flash drum liquid is sent to one column and cold flash drum liquid is sent to a second column. Methods of operating the dual stripper column apparatus are also described.

20 Claims, 3 Drawing Sheets

DUAL STRIPPER COLUMN APPARATUS AND METHODS OF OPERATION

FIELD OF THE INVENTION

The present invention relates generally to stripper columns for separating products made in a reactor, and more particularly to a dual stripper column apparatus in which hot flash drum liquid from a reactor is sent to one column and cold flash drum liquid from the reactor is sent to a second column.

BACKGROUND OF THE INVENTION

Hydroprocessing can include processes which convert hydrocarbons in the presence of hydroprocessing catalyst and hydrogen to more valuable products.

Hydrocracking is a hydroprocessing process in which hydrocarbons crack in the presence of hydrogen and hydrocracking catalyst to lower molecular weight hydrocarbons. Depending on the feed characteristics and desired products, a hydrocracking unit may contain one or more beds of the same or different catalyst.

Due to environmental concerns and newly enacted rules and regulations, saleable fuels must meet lower and lower limits on contaminates, such as sulfur and nitrogen. New regulations require essentially complete removal of sulfur from diesel. For example, the ultra low sulfur diesel (ULSD) requirement is typically less than about 10 wppm sulfur.

Hydrotreating is a hydroprocessing process used to remove heteroatoms such as sulfur and nitrogen from hydrocarbon streams to meet fuel specifications and to saturate olefinic compounds. Hydrotreating can be performed at high or low pressures, but is typically operated at lower pressure than hydrocracking.

Hydroprocessing recovery units typically include a stripper for stripping hydroprocessed effluent with a stripping medium, such as steam, to remove unwanted hydrogen sulfide. The stripped effluent then is heated in a fired heater to fractionation temperature before entering a product fractionation column to recover products such as naphtha, kerosene and diesel.

Hydroprocessing, and particularly hydrocracking, is very energy-intensive due to the severe process conditions such as the high temperature and pressure used. Over time, although much effort has been spent on improving energy performance for hydrocracking, the focus has been on reducing reactor heater duty. However, a large heater duty is required to heat stripped effluent before entering the product fractionation column.

The traditional hydroprocessing design features one stripper which receives two feeds, a relatively cold hydroprocessed effluent stream which may be from a cold flash drum and a relatively hot hydroprocessed effluent stream which may be from a hot flash drum. Although these two feeds contain very different compositions, they can be traced back to the same location from a hydroprocessing reactor and perhaps, a hot separator. An overhead vapor stream of the hot separator may go to a cold separator and the liquid from the cold separator may go to a cold flash drum while a bottoms liquid of the hot separator may go to a hot flash drum. Traditionally, the liquid of both hot and cold flash drums are fed to a single stripper. A stripper bottoms stream may become the feed for the product fractionation column. The inefficiency of this one-stripper design is rooted in mixing of the liquids of the hot flash drum and the cold flash drum in the same stripper which partially undoes the separation previously accomplished in the hot separator.

A conventional hydroprocessing process using a single stripping column is illustrated in FIG. 1. Feed 5 mixes with hydrogen rich recycle gas, is heated, and enters the hydroprocessing reactor 10. The effluent 15 from the reactor 10 is partially cooled and sent to a hot separator 20 where it is separated into a vapor stream 25 and a liquid stream 30. The hot separator 20 operates at elevated temperature, typically about 288° C. (550° F.) to about 315° C. (600° F.).

The liquid stream 30 from the hot separator 20 is sent to a hot flash drum 35 which operates at a lower pressure, typically about 1724 kPa (g) (250 psig) to about 2758 kPa (g) (400 psig). The liquid 40 from the hot flash drum 35 is sent to the stripper column 50.

The vapor stream 25 from the hot separator 20 contains the recycle gas and some vaporized product range hydrocarbons. The vapor stream 25 is cooled to between 60° C. (140° F.) and 43° C. (110° F.) and sent to the cold separator 55. The gas stream 56 from the cold separator may be scrubbed in the recycle gas scrubber 130 which uses an amine to remove hydrogen sulfide. The scrubbed recycle gas 57 is compressed by the recycle gas compressor 135, mixed with makeup gas 150 and the resulting recycle gas 59 is mixed with fresh feed.

The liquid stream 60 from the cold separator 55 is let down in pressure and sent to the cold flash drum 65, which operates at a pressure between about 1724 kPa (g) (250 psig) to about 2758 kPa (g) (400 psig). Gases 70 evolved when the cold separator pressure is let down are separated.

The cold flash liquid 75 is heated to a temperature required by heat balance in order to achieve the objectives of the stripper 50. The heating may be accomplished by exchange with available heat elsewhere in the unit 80.

The bottoms stream 85 from the stripper column 50 may be further heated in exchanger 86 and sent to a separator 90. The vapor stream 95 from the separator 90 is sent to fractionator 100. The liquid stream 105 from the separator is heated in fired heater 110 and then sent to product fractionator 100. The product fractionator separates the vapor and liquid into various hydrocarbon product streams 105, 115, 120, and 125. To improve the separation between the bottoms product 125 and the first sidedraw stream 120, a stripping medium, such as steam, 126 is added.

However, conventional units with single stripper columns are expensive to operate because of the heating required for the streams entering the fractionator.

Therefore, there is a need for more energy efficient methods of separating and recovering the products produced in the reactor.

SUMMARY OF THE INVENTION

One aspect of the invention is a dual stripper apparatus for a reactor, the reactor in fluid communication with a hot flash drum and a cold flash drum. In one embodiment, the apparatus includes a hot flash stripper column having a plurality of trays, the hot flash stripper column having a hot flash liquid inlet in fluid communication with the hot flash drum, an overhead vapor outlet above the hot flash liquid inlet, a stripping medium inlet, and a liquid bottoms outlet. There is a cold flash stripper column having a plurality of trays, the cold flash stripper column having a cold flash liquid inlet in fluid communication with the cold flash drum, the cold flash liquid inlet above an intermediate tray, the intermediate tray between a top tray and a bottom tray, a vapor inlet in fluid communication with the overhead vapor outlet of the hot flash stripper column, and a stripping medium inlet, an overhead vapor outlet, a reflux inlet below the overhead vapor outlet, and a liquid bottoms outlet. There is a receiver having an inlet and an outlet, the receiver inlet in fluid communication with the overhead vapor outlet of the cold flash stripper column, and the receiver outlet being in fluid communication with the reflux inlet of the cold flash stripper column.

Another aspect of the invention is a method of operating a dual stripper apparatus for a reactor, the reactor in fluid communication with a hot flash drum and a cold flash drum. In one embodiment, the method includes providing a dual stripper apparatus including a hot flash stripper column having a plurality of trays, the hot flash stripper column having a hot flash liquid inlet in fluid communication with the hot flash drum, an overhead vapor outlet above the hot flash liquid inlet, a stripping medium inlet, and a liquid bottoms outlet; a cold flash stripper column having plurality of trays, the cold flash stripper column having a cold flash liquid inlet in fluid communication with the cold flash drum, the cold flash liquid inlet above an intermediate tray, the intermediate tray between the top tray and the bottom tray, a vapor inlet in fluid communication with the overhead vapor outlet of the hot flash stripper column, the vapor inlet of the cold flash stripper column at or near the level of the cold flash liquid inlet, and a stripping medium inlet, an overhead vapor outlet, a reflux inlet below the overhead vapor outlet, and a liquid bottoms outlet; a receiver having an inlet and an outlet, the receiver inlet in fluid communication with the overhead vapor outlet of the cold flash stripper column, the receiver outlet being in fluid communication with the reflux inlet of the cold flash stripper column. Stripping medium is introduced into the stripping medium inlet of the hot flash and cold flash stripper columns. Hot flash drum liquid from the hot flash drum is introduced into the hot flash liquid inlet of the hot flash stripper column. Cold flash drum liquid from the cold flash drum is introduced into the cold flash liquid inlet of the cold flash stripper column. Overhead vapor from the hot flash stripper column is introduced into the vapor inlet of the cold flash stripper column. The overhead vapor stream from the cold flash stripper column is separated in the receiver and reflux from the receiver is introduced into the reflux inlet of the cold flash stripper column. The liquid bottoms stream is recovered from the hot flash stripper column, and the liquid bottoms stream is recovered from the cold flash stripper column.

DETAILED DESCRIPTION OF THE INVENTION

One example of a two stripper column design is described in U.S. patent application Ser. No. 13/213,327, filed Aug. 19, 2011, entitled PROCESS FOR RECOVERING HYDROPROCESSED HYDROCARBONS WITH TWO STRIPPERS IN ONE VESSEL; and U.S. patent application Ser. No. 13/213,335, filed Aug. 19, 2011, now U.S. Pat. No. 8,715,596 entitled APPARATUS FOR RECOVERING HYDROPROCESSED HYDROCARBONS WITH TWO STRIPPERS IN ONE VESSEL, which is incorporated herein by reference. One of the advantages of a two stripper column design is a significant reduction in the duty for the fractionator feed heater, typically about a 40% reduction in duty over the single stripper column design.

Figure 1:
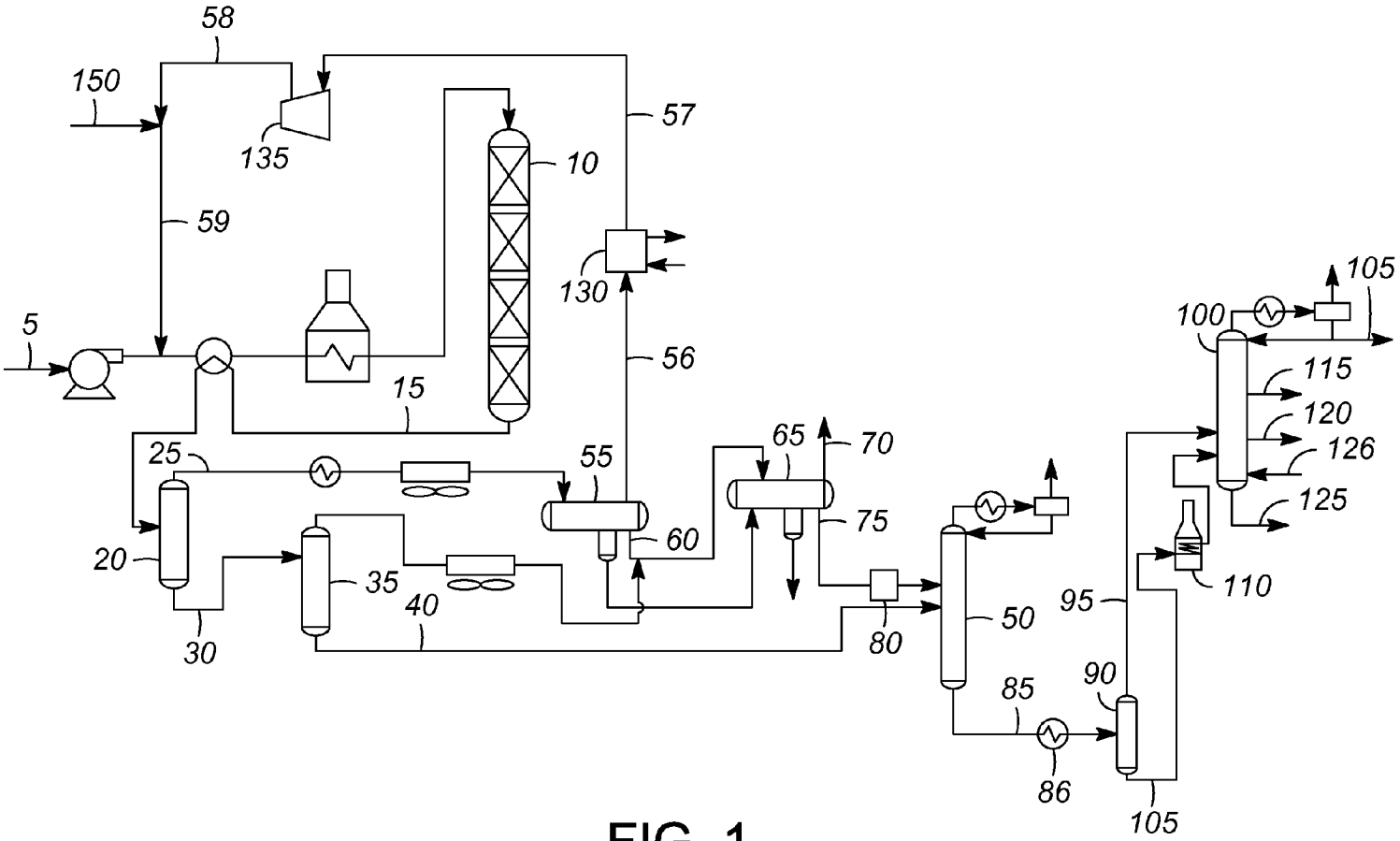
FIG. 1 (Prior Art)
FIG. 1 is an illustration of a prior art process using a single stripper column.
Figure 2:
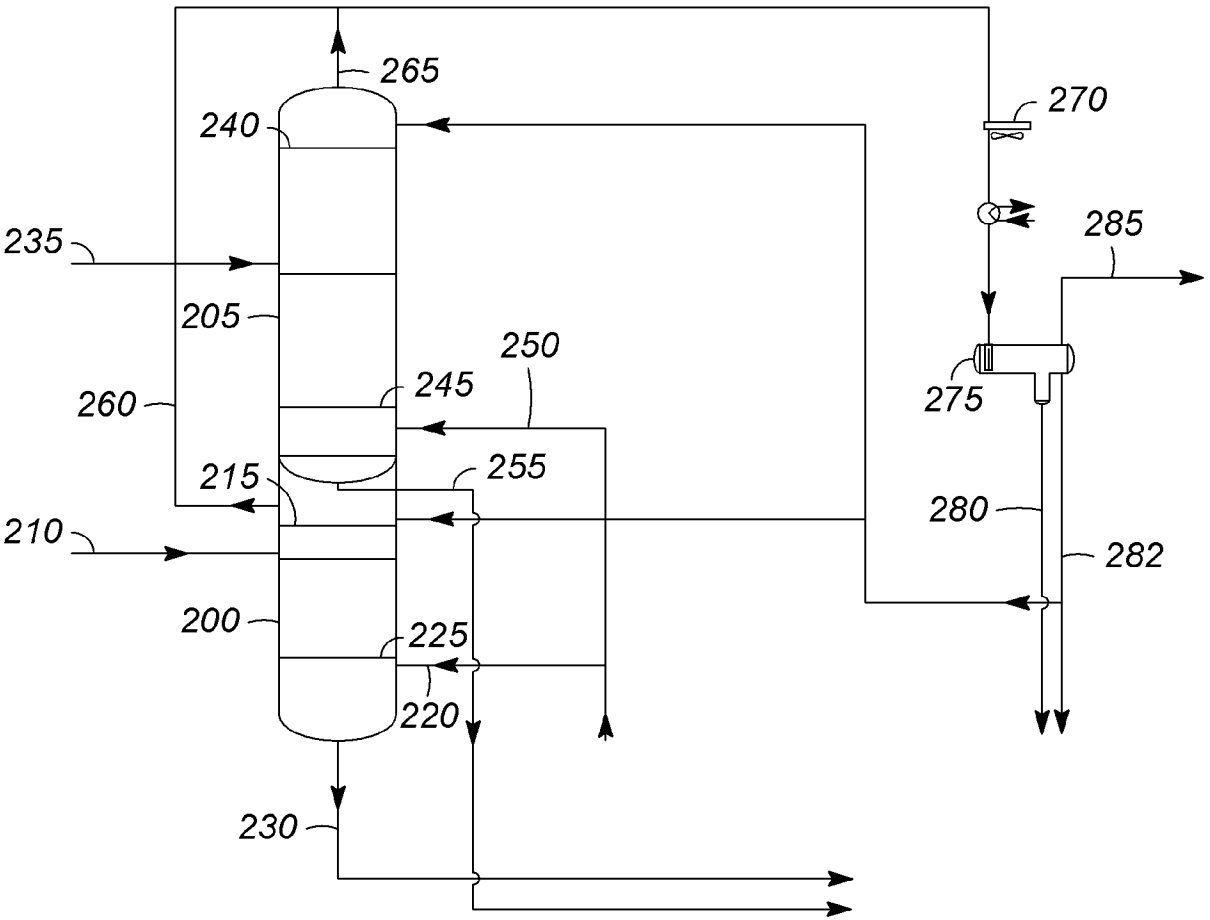
FIG. 2 is an illustration of one embodiment of a dual stripper design.

One embodiment of a two stripper column design is illustrated in FIG. 2. There is a hot flash stripper column 200 and a cold flash stripper column 205. The hot flash stripper column and the cold flash stripper column can be in the same housing (as shown) or in separate housings, as desired. The hot flash liquid 210 from the hot flash drum (not shown) enters the hot stripper column 200 below the top plate 215. Stripping medium 220 enters the hot stripper column 200 below the bottom plate 225. Hot stripper column liquid bottoms stream 230 is sent to the product fractionator column (not shown).

Cold flash drum liquid 235 is sent to cold flash stripper column 205. It enters the cold flash stripper column 205 at a position intermediate between the top plate 240 and the bottom plate 245. Stripping medium 250 enters the cold flash stripper column 205 below the bottom plate 245. The cold flash column liquid bottoms stream 255 is sent to the product fractionator column (not shown).

The hot stripper column overhead vapor stream 260 is combined with the cold flash stripper column overhead vapor stream 265 and sent to a common condenser 270 and receiver 275 where it is separated into a liquid water stream 280, a liquid hydrocarbon stream 282, and a vapor stream 285. The liquid hydrocarbon stream 282 is refluxed to both the hot flash stripper column 200 and the cold flash stripper column 205.

However, in order to achieve a desired 14° C. (25° F.) dewpoint margin in the overhead vapor to prevent water condensation in the top of the column, the hot flash liquid temperature and the liquid hydrocarbon reflux flow rate have to be fairly tightly controlled. In some circumstances, the control needed can be difficult to achieve.

The cold flash stripper does not have this problem because of the relatively large amount of light hydrocarbon material, defined as having a boiling point equal to or lighter than diesel in the feed to that column, compared to hot flash stripper feed. It was discovered that most of the light hydrocarbon material in the hot separator feed passed overhead and ended up in the cold separator and cold flash drum, resulting in a relatively small amount of light hydrocarbon material in the hot flash stripper feed. Consequently, it was determined that the hot flash drum liquid could be fed to the top tray of the hot flash stripper. This would avoid the need to provide reflux to the hot flash stripper column and the resulting difficulty in process control.

Figure 3:
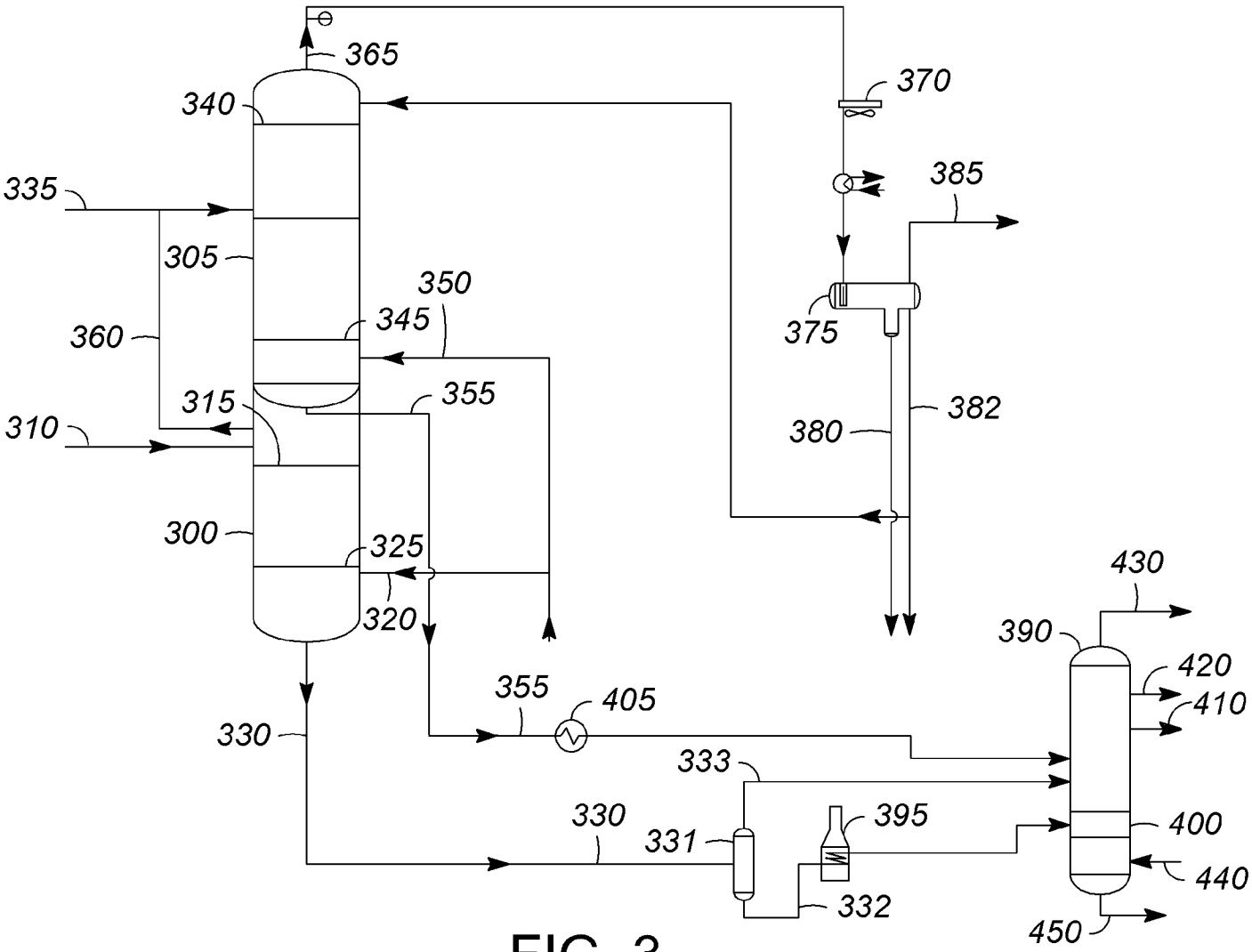
FIG. 3 is an illustration of one embodiment of the dual stripper design of the present invention.

FIG. 3 illustrates one embodiment of a two stripper column arrangement of the present invention. There is a hot flash stripper column 300 and a cold flash stripper column 305. The hot flash liquid 310 from the hot flash drum (not shown) enters the hot stripper column 300 above the top plate 315. Stripping medium 320 enters the hot stripper column 300 below the bottom plate 325. Any suitable stripping medium can be used, including, but not limited to, steam, and column reboiler vapor. Hot stripper column liquid bottoms stream 330 is sent to the product fractionator column 390.

The hot stripper column may be operated with a bottoms temperature between about 160° C. (320° F.) and about 360° C. (680° F.) and an overhead pressure of about 0.5 MPa (gauge) (73 psig) to about 2.0 MPa (gauge) (292 psig).

Cold flash drum liquid 335 is sent to cold flash stripper column 305. It enters the cold flash stripper column 305 at a position intermediate between the top plate 340 and the bottom plate 345. Stripping medium 350 enters the cold flash stripper column 305 below the bottom plate 345. The cold flash column liquid bottoms stream 355 is sent to the product fractionator column 390.

The cold stripper column may be operated with a bottoms temperature between about 149° C. (300° F.) and about 260°

C. (500° F.) and an overhead pressure of about 0.5 MPa (gauge) (73 psig) to about 2.0 MPa (gauge) (290 psig).

The hot stripper column overhead vapor stream 360 is sent to the cold flash stripper column 305. The optimum location for the hot stripper overhead vapor stream 360 to enter the cold flash stripper column 305 is at or near (e.g., within five (5) trays) the same tray as the cold flash drum liquid 335.

The overhead vapor stream 365 from the cold flash stripper column 305 is sent to condenser 370 and receiver 375 where it is separated into a liquid water stream 380, a liquid hydrocarbon stream 382, and a vapor stream 385. The liquid hydrocarbon stream 382 is refluxed to the top of the cold flash stripper column 305. There is desirably no reflux to the hot flash stripper column 300, although some reflux could occur.

The hot flash column liquid bottoms stream 330 may be heated further by exchange with process heat elsewhere in the unit and sent to a separator 331. The liquid 332 is sent to a fired heater 395 before being sent to the flash zone 400 of the fractionator 390. The flash zone 400 facilitates liquid and vapor separation. The vapor 333 from separator 331 is routed to the product fractionator 390. The liquid passes down through stripping trays, and the light material is stripped by the stripping medium. The vapors entering the flash zone contain mainly the distillate and lighter products and pass up the column. The vapors are eventually condensed at a point consistent with the composition and withdrawn from the column either at the diesel or kerosene draws or produced as a net overhead liquid.

The cold flash stripper column liquid bottoms stream is sent to a heat exchanger 405 before entering the fractionator 390 above the flash zone 400 and below the first sidecut draw, 410, which is usually diesel product. Additional sidedraws may be employed, such as kerosene 420. The overhead vapor 430 from the product fractionator contains mainly naphtha range material. Stripping medium 440 is introduced below the bottom stripping trays which are below the flash zone. A stripped unconverted oil stream 450 is withdrawn from the bottom of the product fractionator.

The hot flash column liquid bottoms stream 330 has to be heated to a higher temperature than the cold flash column liquid bottoms stream 355. This is done in the fired heater 395. The cold flash stripper bottoms liquid stream 355 is lighter and does not have to be heated to the same temperature as the hot flash column liquid bottoms stream 330. The required temperature increase for the cold flash column liquid bottoms stream 355 can be achieved with a process heat exchanger 405. This difference in stream heating is the source of the utility savings, primarily in fuel savings.

One concern with the alternate two stripper column arrangement was that the steam entering the hot flash stripper column combined with the steam entering the cold flash stripper column would depress the dew point margin at the top of the cold flash stripper column. However, it has been found that there is sufficient dewpoint margin at the top of the cold flash stripper column that the steam does not cause a problem. In addition, if the hot flash stripper overhead vapor is fed near the cold flash liquid feed tray, the $H_2S$ present in the hot flash stripper overhead vapor is stripped out so that the cold flash stripper column liquid bottoms stream has essentially the same $H_2S$ content as the original two stripper column arrangement. The optimum feed point for the hot flash stripper overhead vapor stream to the cold flash stripper column is at or near the same tray as the cold flash drum feed tray.

Another concern was that some unconverted oil would be present in the overhead vapor from the hot flash stripper because the hot flash stripper is not refluxed. If enough heavy material was present in the overhead vapor, it could end up in the cold flash stripper column bottoms and adversely affect the ASTM D-86 95% vaporization temperature for the diesel product. However, it was determined that the hot flash stripper overhead vapor does not contain enough unconverted oil to affect the composition of the cold flash stripper bottoms liquid. The D-86 distillation 95% and endpoint temperatures of the cold flash stripper bottoms liquid stream is less than 5° F. (3° C.) different from the original two stripper column design.

Among the benefits of the present two stripper column design is a reduction in fractionator heat duty compared to the conventional one stripper column arrangement as well as the original two stripper column design. The reduction is about 50% compared to the single stripper column, and over 15% compared to the original two stripper design. The difference between the two stripper column arrangements arises from the fact that the hot flash stripper column is not refluxed in the new design. In the original design, a portion of the hot flash stripper reflux was exiting the bottom of the hot flash stripper column, resulting in an increased volume of material fed to the heater.

EXAMPLE

Table 1 shows a comparison of the performance of the new design with a conventional single stripper design, and the original two stripper design, via computer modeling.

TABLE 1

| Parameter | Single Stripper | 2 Stripper (previous) | 2 Stripper (new) |
|---|---|---|---|
| Cold Flash Stripper Feed Temperature, ° F. | 400 | 440 | 440 |
| Hot Flash Stripper Feed Temperature, ° F. | 560 | 560 | 560 |
| Overhead Condenser Duty, MMBTU/hr | 50.93 | 46.03 | 42.61 |
| Cold Flash Stripper Dewpoint Margin, ° F. | 40 | 110 | 33 |
| Hot Flash Stripper Dewpoint Margin, ° F. | — | 27 | 234 |
| Total Reflux Liquid, BPSD | 5217 | 10246 | 8708 |
| Net Overhead Liquid, BPSD | 9002 | 4614 | 4819 |
| Net Ovhd Liquid Distillation (D-86 95%) | 282 | 279 | 272 |
| Cold Flash Stripper Bottoms Liquid | | | |
| Flow Rate, BPSD | — | 17923 | 20226 |
| H2S content, ppb | — | 580 | 587 |
| D-86 95% Distillation Temp, ° F. | — | 653 | 657 |
| Hot Flash Stripper Bottoms Liquid | | | |
| Flow Rate, BPSD | 10686 | 89512 | 86975 |
| H2S content, ppb | 77 | 1000 | 213 |
| TBP IBP Distillation Temp, ° F. | 205 | 200 | 230 |
| Prod Frac Feed Heater Duty, MMBTU/hr | 149.43 | 90.64 | 75.76 |
| Diesel Product D-86 95% Temp, ° F. | 669 | 667 | 672 |

The process and apparatus described herein are particularly useful for hydroprocessing a hydrocarbonaceous feedstock. Illustrative hydrocarbon feedstocks include hydrocarbonaceous streams having components boiling above about 288° C. (550° F.), such as atmospheric gas oils, vacuum gas oil (VGO) boiling between about 315° C. (600° F.) and about 565° C. (1050° F.), deasphalted oil, coker distillates, straight run distillates, pyrolysis-derived oils, high boiling synthetic oils, cycle oils, hydrocracked feeds, catalytic cracker distillates, atmospheric residue boiling at or above about 343° C. (650° F.) and vacuum residue boiling above about 510° C. (950° F.).

Hydroprocessing includes hydrocracking and hydrotreating. Hydrocracking refers to a process in which hydrocarbons crack in the presence of hydrogen to lower molecular weight hydrocarbons. Hydrocracking also includes slurry hydrocracking in which resid feed is mixed with catalyst and hydrogen to make a slurry and cracked to lower boiling products. VGO in the products may be recycled to manage coke precursors referred to as mesophase. Hydrotreating is a process wherein hydrogen is contacted with hydrocarbon in the presence of suitable catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics. The cloud point of the hydrotreated product may also be reduced.

The hydroprocessing reactor may be a fixed bed reactor that comprises one or more vessels, single or multiple beds of catalyst in each vessel, and various combinations of hydrotreating catalyst and/or hydrocracking catalyst in one or more vessels. It is contemplated that the hydroprocessing reactor be operated in a continuous liquid phase in which the volume of the liquid hydrocarbon feed is greater than the volume of the hydrogen gas. The hydroprocessing reactor may also be operated in a conventional continuous gas phase, a moving bed or a fluidized bed hydroprocessing reactor.

If the hydroprocessing reactor is operated as a hydrocracking reactor, it may provide total conversion of at least about 20 vol-% and typically greater than about 60 vol-% of the hydrocarbon feed to products boiling below the diesel cut point. A hydrocracking reactor may operate at partial conversion of more than about 50 vol-% or full conversion of at least about 90 vol-% of the feed based on total conversion. A hydrocracking reactor may be operated at mild hydrocracking conditions which will provide about 20 to about 60 vol-%, preferably about 20 to about 50 vol-%, total conversion of the hydrocarbon feed to product boiling below the diesel cut point. If the hydroprocessing reactor is operated as a hydrotreating reactor, it may provide conversion per pass of about 10 to about 30 vol-%.

If the hydroprocessing reactor is a hydrocracking reactor, the first vessel or bed in the hydrocracking reactor may include hydrotreating catalyst for the purpose of saturating, demetallizing, desulfurizing or denitrogenating the hydrocarbon feed before it is hydrocracked with hydrocracking catalyst in subsequent vessels or beds in the hydrocracking reactor. If the hydrocracking reactor is a mild hydrocracking reactor, it may contain several beds of hydrotreating catalyst followed by fewer beds of hydrocracking catalyst. If the hydroprocessing reactor is a slurry hydrocracking reactor, it may operate in a continuous liquid phase in an upflow mode. If the hydroprocessing reactor is a hydrotreating reactor, it may comprise more than one vessel and multiple beds of hydrotreating catalyst. The hydrotreating reactor may also contain hydrotreating catalyst that is suited for saturating aromatics, hydrodewaxing and hydroisomerization.

Any known hydrocracking and hydrotreating catalysts may be used. Typical hydrocracking catalysts utilize amorphous silica-alumina bases or low-level zeolite bases combined with one or more Group VIII or Group VIB metal hydrogenating components if mild hydrocracking is desired to produce a balance of middle distillate and gasoline. When middle distillate is significantly preferred in the converted product over gasoline production, partial or full hydrocracking may be performed in the first hydrocracking reactor with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8-12 Angstroms ($10^{-10}$ meters), wherein the silica/alumina mole ratio is about 4 to 6. One example of a zeolite falling in the preferred group is synthetic Y molecular sieve.

The active metals employed in the hydrocracking catalysts as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt-%.

Suitable hydrocracking conditions may include a temperature from about 290° C. (550° F.) to about 468° C. (875° F.), or 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.3 to less than about 2.5 $hr^{-1}$, and a hydrogen rate of about 421 (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ or 0.7 to about 1.5 $hr^{-1}$, and a hydrogen rate of about 421 $Nm^3/m^3$ oil (2,500 scf/bbl) to about 1,685 $Nm^3/m^3$ oil (10,000 scf/bbl).

Slurry hydrocracking catalysts are typically ferrous sulfate hydrates having particle sizes less than 45 μm and with a major portion, i.e. at least 50% by weight, in an aspect, having particle sizes of less than 10 μm. Iron sulfate monohydrate is a suitable catalyst. Bauxite catalyst may also be suitable. In an aspect, 0.01 to 4.0 wt-% of catalyst based on fresh feedstock are added to the hydrocarbon feed. Oil soluble catalysts may be used alternatively or additionally. Oil soluble catalysts include metal naphthenate or metal octanoate, in the range of 50-1000 wppm based on fresh feedstock. The metal may be molybdenum, tungsten, ruthenium, nickel, cobalt or iron.

A slurry hydrocracking reactor may be operated at a pressure in the range of 3.5 MPa (gauge) (508 psig) to 24 MPa (gauge) (3,481 psig) without coke formation in the reactor. The reactor temperature may be in the range of about 350° to 600° C. with a temperature of about 400° to 500° C. being typical. The LHSV is typically below about 4 $h^{-1}$ on a fresh feed basis, with a range of about 0.1 to 3 $hr^{-1}$ being suitable, or a range of about 0.2 to 1 $hr^{-1}$. The per-pass pitch conversion may be between 50 and 95 wt-%. The hydrogen feed rate may be about 674 to about 3370 $Nm^3/m^3$ (4000 to about 20,000 SCF/bbl) oil. An antifoaming agent may also be added to the slurry hydrocracking reactor to reduce the tendency to generate foam, if desired.

Suitable hydrotreating catalysts for use in the present invention are any known conventional hydrotreating catalysts and include those which are comprised of at least one Group VIII metal, for example, iron, cobalt and nickel, with cobalt and/or nickel being desirable, and at least one Group VI metal, for example, molybdenum and tungsten, on a high surface area support material, such as alumina. Other suitable hydrotreating catalysts include zeolitic catalysts, as well as noble metal catalysts where the noble metal is selected from palladium and platinum. More than one type of hydrotreating catalyst can be used in the same hydrotreating reactor, if desired. The Group VIII metal is typically present in an amount ranging from about 2 to about 20 wt-%, or from about 4 to about 12 wt-%. The Group VI metal will typically be present in an amount ranging from about 1 to about 25 wt-%, or from about 2 to about 25 wt-%.

Suitable hydrotreating reaction conditions include a temperature from about 290° C. (550° F.) to about 455° C. (850° F.), or about 316° C. (600° F.) to about 443° C. (830° F.), or about 343° C. (650° F.) to about 399° C. (750° F.), a pressure from about 2.1 MPa (gauge) (300 psig), or abut 4.1 MPa (gauge) (600 psig) to about 20.6 MPa (gauge) (3000 psig), or about 12.4 MPa (gauge) (1800 psig), or about 6.9 MPa (gauge) (1000 psig), a liquid hourly space velocity of the fresh hydrocarbonaceous feedstock from about 0.1 $hr^{-1}$ to about 4 $hr^{-1}$, or about 0.5 $hr^{-1}$ to about 4 $hr^{-1}$, or from about 1.5 to about 3.5 $hr^{-1}$, and a hydrogen rate of about 168 $Nm^3/m^3$ (1,000 scf/bbl) to about 1,011 $Nm^3/m^3$ oil (6,000 scf/bbl), or about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A dual stripper apparatus for a reactor, the reactor in fluid communication with a hot flash drum and a cold flash drum, the dual stripper apparatus comprising:

a hot flash stripper column having a plurality of trays, the hot flash stripper column having a hot flash liquid inlet in fluid communication with the hot flash drum, an overhead vapor outlet above the hot flash liquid inlet, a stripping medium inlet, and a liquid bottoms outlet;

a cold flash stripper column having a plurality of trays, the cold flash stripper column having a cold flash liquid inlet in fluid communication with the cold flash drum, the cold flash liquid inlet above an intermediate tray, the intermediate tray between a top tray and a bottom tray, a vapor inlet in fluid communication with the overhead vapor outlet of the hot flash stripper column, a stripping medium inlet, an overhead vapor outlet, a reflux inlet below the overhead vapor outlet, and a liquid bottoms outlet; and a receiver having an inlet and an outlet, the receiver inlet in fluid communication with the overhead vapor outlet of the cold flash stripper column, and the receiver outlet being in fluid communication with the reflux inlet of the cold flash stripper column.

2. The dual stripper apparatus of claim 1 wherein the hot flash and cold flash stripper columns are contained in a single housing, the hot flash stripper column being positioned below the cold flash stripper column.

3. The dual stripper apparatus of claim 1 wherein the hot flash liquid inlet is above a top tray of the hot flash stripper column.

4. The dual stripper apparatus of claim 1 wherein the vapor inlet of the cold flash stripper column is within 5 trays of the cold flash liquid inlet.

5. The dual stripper apparatus of claim 1 wherein there is no overhead reflux inlet in the hot flash stripper column.

6. The dual stripper apparatus of claim 1 further comprising a product fractionator having a hot flash inlet in fluid communication with the hot flash stripper column liquid bottoms outlet, the hot flash inlet in a flash zone of the product fractionator, and a cold flash inlet in fluid communication with the cold flash stripper liquid bottoms outlet, the cold flash inlet located between the hot flash inlet and a lowest product outlet.

7. The dual stripper apparatus of claim 6 further comprising a fired heater in thermal communication with the hot flash stripper column liquid bottoms, the heater positioned between the hot flash stripper column and the product fractionator.

8. The dual stripper apparatus of claim 6 further comprising a heat exchanger in thermal communication with the cold flash stripper column liquid bottoms, the heat exchanger positioned between the cold flash stripper column and the product fractionator.

9. A dual stripper apparatus for a reactor, the reactor in fluid communication with a hot flash drum and a cold flash drum, the dual stripper apparatus comprising:

a hot flash stripper column having a plurality of trays, the hot flash stripper column having a hot flash liquid inlet in fluid communication with the hot flash drum, the hot flash liquid inlet above a top tray of the hot flash stripper column, an overhead vapor outlet above the hot flash liquid inlet, a stripping medium inlet below a bottom tray, and a liquid bottoms outlet below the bottom tray;

a cold flash stripper column having plurality of trays, the cold flash stripper column having a cold flash liquid inlet in fluid communication with the cold flash drum, the cold flash liquid inlet above an intermediate tray, the intermediate tray between a top tray and a bottom tray, a vapor inlet in fluid communication with the overhead vapor outlet of the hot flash stripper column, the vapor inlet at or near the level of the cold flash liquid inlet, a stripping medium inlet below the bottom tray, an overhead vapor outlet above the top tray, a reflux inlet above the top tray and below the overhead vapor outlet, and a liquid bottoms outlet below the bottom tray;

a receiver having an inlet and an outlet, the receiver inlet in fluid communication with the overhead vapor outlet of the cold flash stripper column, and the receiver outlet being in fluid communication with the reflux inlet of the cold flash stripper column; and wherein the hot flash and cold flash stripper columns are contained in a single housing, the hot flash stripper column being positioned below the cold flash stripper column, and wherein there is no overhead reflux inlet in the hot flash stripper column.

10. The dual stripper apparatus of claim 9 further comprising a product fractionator having a hot flash inlet in fluid communication with the hot flash stripper column liquid bottoms outlet, the hot flash inlet in a flash zone of the fractionator, a cold flash inlet in fluid communication with the cold flash stripper liquid bottoms outlet, the cold flash inlet located between the hot flash inlet and a lowest product outlet.

11. The dual stripper apparatus of claim 10 further comprising a fired heater in thermal communication with the hot flash stripper column liquid bottoms, the heater positioned between the hot flash stripper column and the product fractionator and a heat exchanger in thermal communication with the cold flash stripper column liquid bottoms, the heat exchanger positioned between the cold flash stripper column and the product fractionator.

12. A method of operating a dual stripper apparatus for a reactor, the reactor in fluid communication with a hot flash drum and a cold flash drum, the method comprising:

providing a dual stripper apparatus comprising:

a hot flash stripper column having a plurality of trays, the hot flash stripper column having a hot flash liquid inlet in fluid communication with the hot flash drum, an overhead vapor outlet above the hot flash liquid inlet, a stripping medium inlet, and a liquid bottoms outlet;

a cold flash stripper column having plurality of trays, the cold flash stripper column having a cold flash liquid inlet in fluid communication with the cold flash drum, the cold flash liquid inlet above an intermediate tray, the intermediate tray between a top tray and a bottom tray, a vapor inlet in fluid communication with the overhead vapor outlet of the hot flash stripper column, a stripping medium inlet, an overhead vapor outlet, a reflux inlet below the overhead vapor outlet, and a liquid bottoms outlet;

a receiver having an inlet and an outlet, the receiver inlet in fluid communication with the overhead vapor outlet of the cold flash stripper column, the receiver outlet being in fluid communication with the reflux inlet of the cold flash stripper column;

introducing a stripping medium into the stripping medium inlet of the hot flash and cold flash stripper columns;

introducing a hot flash liquid from the hot flash drum into the hot flash liquid inlet of the hot flash stripper column;

introducing a cold flash drum liquid from the cold flash drum into the cold flash liquid inlet of the cold flash stripper column;

introducing overhead vapor from the hot flash stripper column into the vapor inlet of the cold flash stripper column;

separating an overhead vapor stream from the cold flash stripper column in the receiver and introducing reflux from the receiver into the reflux inlet of the cold flash stripper column;

recovering a liquid bottoms stream from the hot flash stripper column; and recovering a liquid bottoms stream from the cold flash stripper column.

13. The method of claim 12 wherein a temperature of the cold flash drum liquid is adjusted to maintain at least about 8° C. (15° F.) difference between a water dew point of the cold flash overhead vapor stream and a temperature of the cold flash stripper overhead vapor stream.

14. The method of claim 12 wherein the hot flash and cold flash stripper columns are contained in a single housing, the hot flash stripper column being positioned below the cold flash stripper column.

15. The method of claim 12 wherein liquid bottoms stream from the cold flash stripper column contains less than about 10 vol % of the unconverted oil.

16. The method of claim 12 further comprising;

introducing the hot flash stripper column liquid bottoms stream into a flash zone of a product fractionator;

introducing the cold flash stripper column liquid bottoms into the product fractionator at a position below the flash zone and above a bottoms product outlet.

17. The method of claim 16 further comprising heating the hot flash stripper column liquid bottoms stream in a heater before introducing the hot flash stripper column liquid bottom stream into the product fractionator.

18. The method of claim 16 further comprising heating the cold flash stripper column liquid bottoms stream in a heat exchanger before introducing the cold flash stripper column liquid bottom stream into the product fractionator.

19. The method of claim 12 wherein there is no overhead reflux inlet in the hot flash stripper column.

20. The method of claim 12 wherein the stripping medium is steam.

* * * * *